US007070122B2

(12) United States Patent
Burcham et al.

(10) Patent No.: US 7,070,122 B2
(45) Date of Patent: Jul. 4, 2006

(54) WOBBLING SPRINKLER HEAD

(75) Inventors: Gregory S. Burcham, Clermont, FL (US); William J. McFadden, Clermont, FL (US)

(73) Assignee: Senninger Irrigation Inc., Clermont, FL (US)

( * ) Notice: Subject to any disclaimer, the term of this patent is extended or adjusted under 35 U.S.C. 154(b) by 325 days.

(21) Appl. No.: 10/633,477

(22) Filed: Aug. 4, 2003

(65) Prior Publication Data

US 2005/0029364 A1 Feb. 10, 2005

(51) Int. Cl.
*B05B 3/08* (2006.01)

(52) U.S. Cl. ..... 239/231; 239/225.1; 239/230; 239/232; 239/236; 239/242; 239/264; 239/265; 222/11; 169/37

(58) Field of Classification Search ..... 239/225.1, 239/230, 231, 232, 233, 236, 242, 222.17, 239/222.21, 264, 265; 222/11; 169/37
See application file for complete search history.

(56) References Cited

U.S. PATENT DOCUMENTS 3,009,648 A 11/1961 Hait
3,034,728 A 5/1962 Hruby, Jr.
3,091,400 A 5/1963 Aubert
3,682,388 A * 8/1972 Ferguson ..... 239/222.17
4,356,972 A * 11/1982 Vikre ..... 239/173
4,487,368 A 12/1984 Clearman
4,773,594 A 9/1988 Clearman
5,381,960 A * 1/1995 Sullivan et al. ..... 239/222.21
5,950,927 A 9/1999 Elliott et al.
6,176,440 B1 1/2001 Elliott
6,186,414 B1 * 2/2001 Clearman et al. ..... 239/214
6,530,532 B1 * 3/2003 Santiesteban et al. ..... 239/233

* cited by examiner

*Primary Examiner*—David A. Scherbel
*Assistant Examiner*—James S. Hogan
(74) *Attorney, Agent, or Firm*—William M. Hobby, III

(57) ABSTRACT

A wobbling irrigation sprinkler head for attachment to a water conduit has a wobbling sprinkler head facing upward from the water supply conduit. The sprinkler head has a base having an attachment portion for attaching to a water source and a nozzle mounted to the base for directing water therethrough. A wobbling water deflector head is movably attached to the base and has a water deflector pad thereon having a deflector surface of predetermined shape to deflect water being emitted from the nozzle to rotate the wobbling water deflector head. A counterbalancing skirt extends from the water deflecting head around a portion of the base and spaced from the base for rotation with a wobbling water deflector head so that counterbalancing the skirt counterbalances the water deflector head to dampen vibration forces in the deflector head. The counterbalancing skirt flares from the water deflecting head adjacent to and surrounding the base and has a plurality of open areas therein and is positioned for the balancing point of the wobbling deflector head to be below the rotation point of the wobbling deflector head.

10 Claims, 2 Drawing Sheets

WOBBLING SPRINKLER HEAD

BACKGROUND OF THE INVENTION

The present invention relates to a wobbling sprinkler head and especially to a wobbling sprinkler head for use in irrigation systems and the like.

There have been a number of wobbling sprinkler heads used in the past in which the water distribution head of the sprinkler, instead of being rotated in a smooth rotation or instead of following one of the other sprinkler patterns, has a water distribution head which wobbles in a rotating fashion to provide a more even distribution of water. In the Clearman patents, U.S. Pat. No. 4,487,368 and U.S. Pat. No. 4,773,594, a control pattern wobbling sprinkler is provided in which a rotating sprinkler head has a wobbling water distribution head mounted on the end thereof which has a plurality of vanes formed in the wobbling portion of the head to force a wobbling motion which results from the loose connection between the distribution head and the supporting arm of the sprinkler head. In the sprinkler of these two patents, a base is provided for ground support and a rotating sprinkler head has the end of the rotating arm bent at an angle so that the loosely attached wobbling head tilts groundward when not being used. Upon initiation of water under pressure to the head, the head is already in a cocked position and forces a rotating action which causes a wobbling rotation of the water head portion. In the J. M. Hait patent, U.S. Pat. No. 3,009,648, an irrigation system is provided in which the sprinkler head has a rotating stream of water issuing therefrom but allows a deflection head to move back and forth. In J. O. Hruby, Jr., U.S. Pat. No. 3,034,728, a lawn sprinkler is shown which has a centrally disposed and vertically extending stem which is made to rotate by the action of the water passing through the sprinkler. The stem is loosely mounted and has an uneven deflecting portion to produce a rotating action of the spray. In the M. S. Aubert patent, U.S. Pat. No. 3,091,400, a dishwashing machine has a rotary wobbling spring head which is driven by the water momentum to wobble the head in a dishwasher.

In Applicant's U.S. Pat. No. 5,381,960, a wobbling irrigation sprinkler head includes a magnet for the initial tilt in a wobbling irrigation sprinkler head for use on a self-propelled mechanical moving irrigation system, such as a center pivot field irrigation system, having the wobbling sprinkler head facing downward from the water supply conduit. This sprinkler head produces a wobbling motion as a result of the nozzle directing water onto a deflector pad having a predetermined shape with water deflecting grooves which rotates and wobbles the water deflecting head. A magnet is mounted in the sprinkler head base to attract a ferric metal washer mounted in the wobbling deflecting head to tilt the wobbling water deflector head relative to the base to cock the deflector head to initiate the wobbling in the deflector head.

In Applicant's prior U.S. Pat. No. 5,950,927 for a Wobbling Sprinkler Head, a wobbling irrigation sprinkler head is for use on a self-propelled mechanical moving irrigation system, such as a center pivot field irrigation system, in which the sprinkler heads face downward from the water supply conduit. This sprinkler head produces a wobbling motion as a result of the nozzle directing water onto a deflector pad having a predetermined shape with water deflecting grooves which cause a rotation and wobbling of the water deflecting head. The wobbling motion is produced by a wobble mechanism which has a pair of interacting wobble generating members, one mounted on the water deflecting head and the other mounted on the sprinkler body to keep the water deflection head titled at an angle to the water exiting the water nozzle. The interaction of the protruding members forces the deflection head to start wobbling as the deflection head rotates and maintains the wobble. The water deflection head is blocked from the center axis position to keep the water deflecting surface at an angle to the stream of water being emitted from the nozzle.

One of the problems that occurs with a commercial wobble sprinkler head is the vibration created in the sprinkler head by the wobbling action which can result in wear and premature failure of a wobbling sprinkler head. The present invention is a wobbling sprinkler head which reduces the vibration in the sprinkler head. A water deflection head is rotated by a stream of water from a water nozzle.

In Applicant's U.S. Pat. No. 6,176,440, the interaction of a pair of wobble generating members forces the water deflection head to start wobbling as the deflection head rotates. The water deflection head is prevented from the center position by the interacting wobble generating members to keep the water deflecting surface at an angle to the stream of water being emitted from the nozzle. Once the deflection head starts rotating, the protruding members do not touch since the circle of rotation is outside a stationary wobble generating member. A predetermined mass is removably attached to the sprinkler head along the base of the sprinkler head to dampen vibrations in the sprinkler head generated by the wobbling deflector head. The mass is removably attached to allow for the change of the mass depending upon the operating conditions of the sprinkler head.

In the present invention, a wobbling sprinkler head has a wobbling deflector having a skirt extending outwardly therefrom to counterbalance the deflector head and reduce vibration.

SUMMARY OF THE INVENTION

A wobbling irrigation sprinkler head for attachment to a water conduit has a wobbling sprinkler head facing upward from the water supply conduit. The sprinkler head has a base having an attachment portion for attaching to a water source and a nozzle mounted to the base for directing water therethrough. A wobbling water deflector head is movably attached to the base and has a water deflector pad thereon having a deflector surface of predetermined shape to deflect water being emitted from the nozzle to rotate the wobbling water deflector head. A counterbalancing skirt extends from the water deflecting head around a portion of the base and spaced from the base for rotation with a wobbling water deflector head so that counterbalancing the skirt counterbalances the water deflector head to dampen vibration forces in the deflector head. The counterbalancing skirt flares from the water deflecting head adjacent to and surrounding the base and has a plurality of open areas therein and is positioned for the balancing point of the wobbling deflector head to be below the rotation point of the wobbling deflector head.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
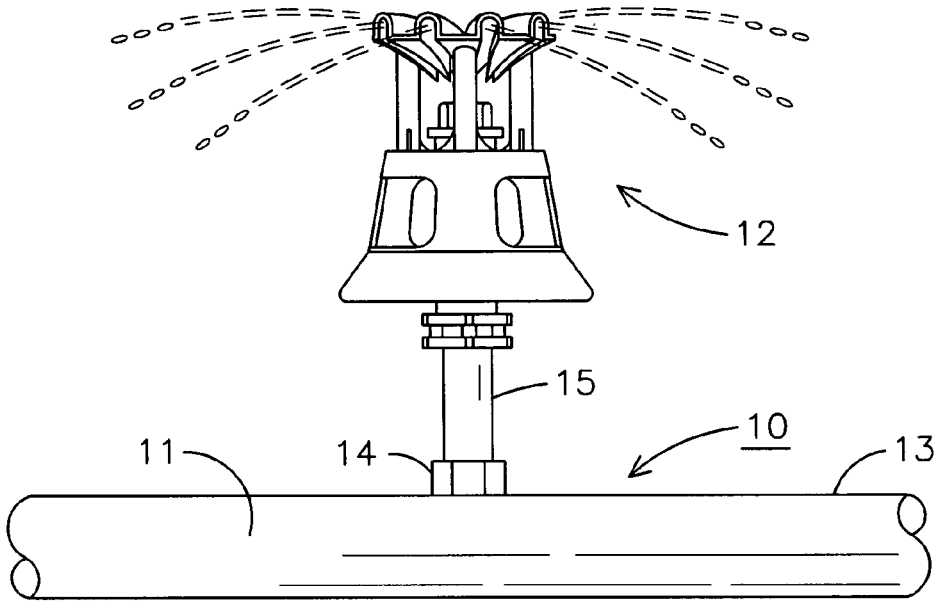
FIG. 1 is a side elevation of a portion of a water conduit having the present sprinkler head.

Referring to FIG. 1 of the drawings, a portion of a water conduit of an irrigation system 10 has a central irrigation conduit or water supply pipe 11 having a plurality of sprinkler heads 12 attached thereto in a spaced relationship to each other. In this case, each sprinkler head 12 extends from the top 13 of the pipe 11 and includes a pipe coupling 14 attached thereto. A pipe 15 may be any length desired and has a U-shaped bend and has the sprinkler head 12 attached thereto.

Figure 2:
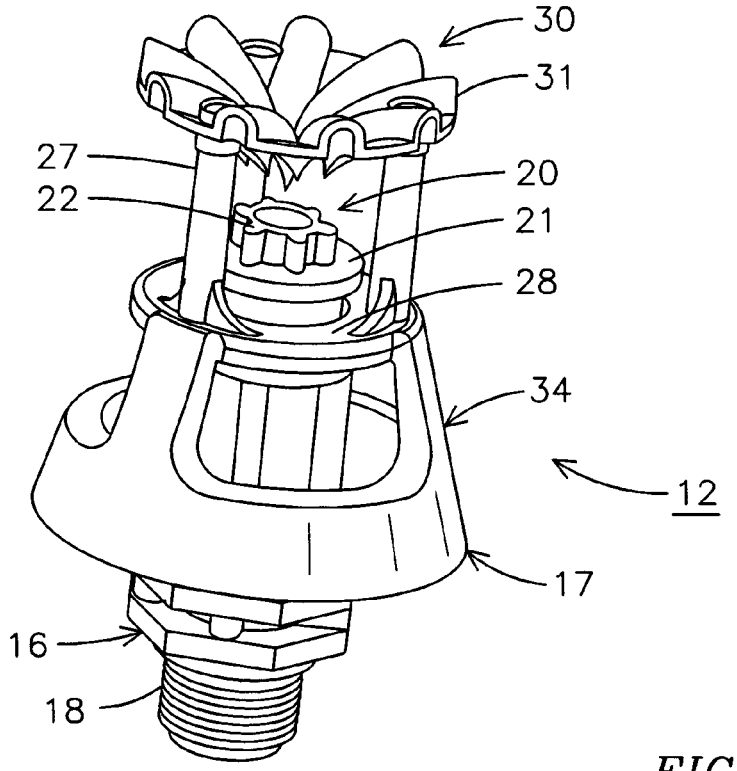
FIG. 2 is a perspective view of the wobbling sprinkler head in accordance with the present invention.
Figure 3:
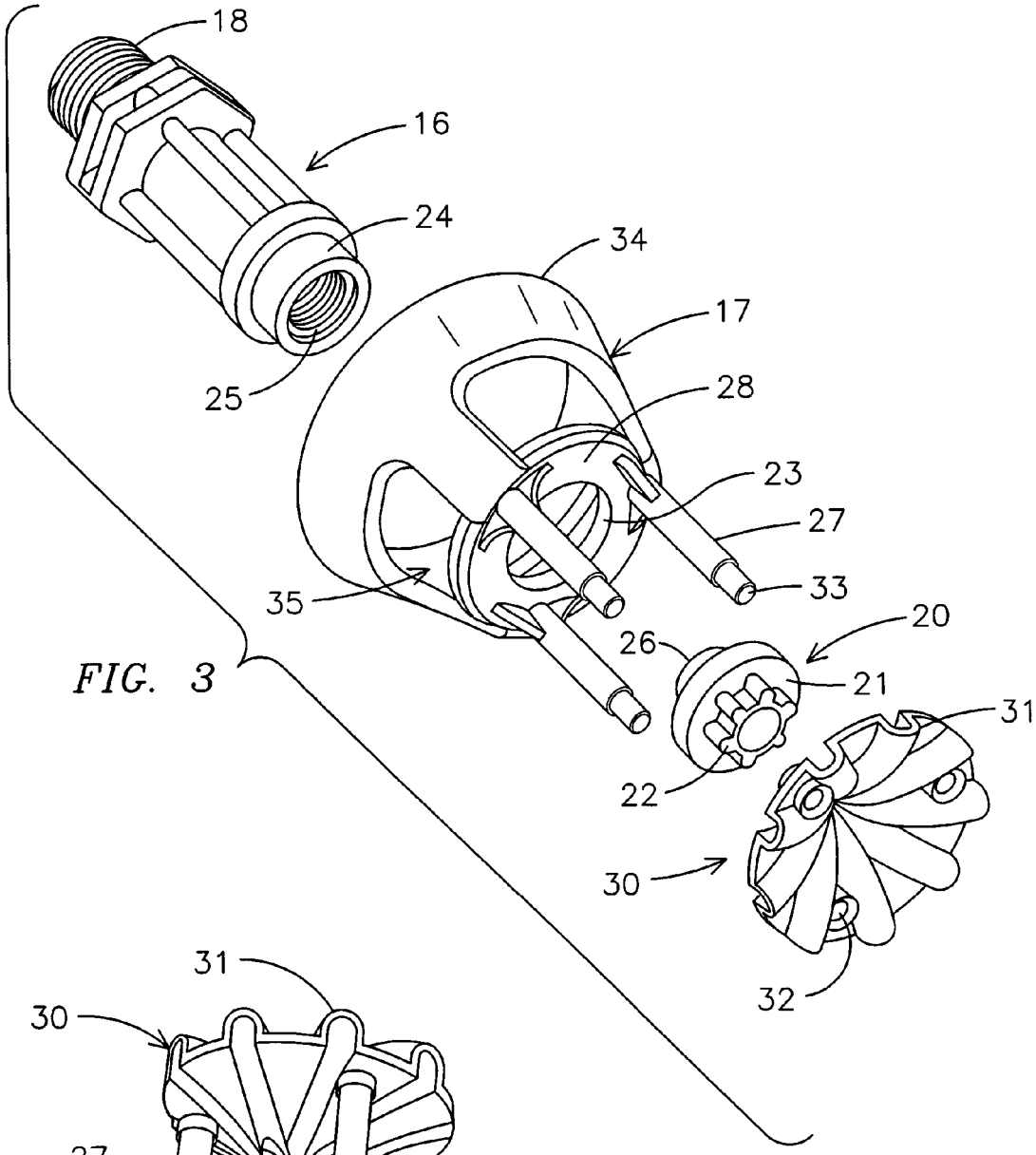
FIG. 3 is an exploded view of the sprinkler head of FIG. 2.
Figure 4:
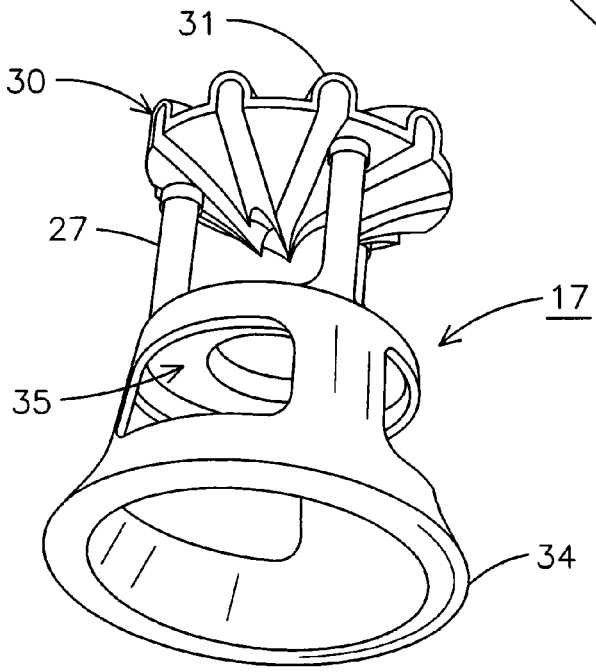
FIG. 4 is a perspective view of a wobbling water deflector head of FIGS. 1–3.

The sprinkler head 12 as seen in FIGS. 1–4 includes a base portion 16 having a wobbling water deflector head 17 rotatably attached to the base 16. The base 16 has external threads 18 for connecting to a water supply for directing water through a nozzle 20. The nozzle 20 has a flange 21 and gripping ridges 22 thereon. The wobbling water deflector head 17 has an opening 23 therein for mounting onto the base 16 supporting ring 24. The ring 24 has internal threads 25 for attaching external threads 26 of a nozzle 20 thereinto. The wobbling water deflector head 17 includes a plurality of posts 27 extending from a base circle 28 and attaching to a water deflector pad 30. The water deflector pad 30 has a plurality of arcuate grooves 31 mounted therein for directing water from the nozzle 20 thereagainst. The deflector pad 30 has a plurality of apertures 32 therein for attaching to the posts 27 with a threaded fastener passing through the apertures 32 and into the threaded openings 33. The ring 28 of the deflector head 17 has a flared skirt 34 extending therefrom which has a plurality of open areas 35 therethrough so that when attached to the sprinkler head 12, as shown in FIG. 2, the wobbling water deflector head 17 skirt 34 extends around the base 16. The wobbling water deflector head 17 is held to the base 16 by the opening 23 fitting over the support sleeve 25 in a loose manner to allow it to rotate and wobble thereon. The deflector head 17 is held to the base 16 with the nozzle 20 which has the threads 26 threaded into the threaded opening 25 and which has a flange 21 larger than the opening 23 to hold the deflector head in a manner that can rotate and wobble. The flared skirt 34 adds a flared weight extending below the main portion of the water deflector head in the opposite direction from the water deflector pad 30 to counterbalance the water deflector head to dampen vibration forces in the deflector head when the deflector head is rotating in a wobbling fashion.

In operation, the water under pressure passing through the frame 16 from a water source, such as the pipe 11 of FIG. 1, is directed through the nozzle 20 and onto the deflector pad 30 which, by virtue of the grooves 31, forces a rotation of the wobbling water deflector head 17 with the open area 23 riding on the support ring 25. The deflector head and expelled water are acting in unison to create an unbalanced force in the same direction, by attaching the outwardly tapered skirt 34, the balance point of the rotating water deflector head 17 is moved below the rotation point. Moving the balance point approximately 0.5 centimeters (0.2 inches) below the rotation point of the sprinkler head 12 reduces or eliminates the vibration in the wobbling water deflector. The angle of the tapered skirt 17 is important in that a highly flared skirt places the rotational mass away from the center point of rotation. Slow rotation rates create a larger vibration amplitude and thus more damaging vibration so that by keeping the taper as slight as possible, the rotation mass is kept closer to the center of rotation and yields a slightly faster but smoother rotation rate.

In the present sprinkler head, as illustrated, 10 degrees is the minimum angle that will clear the mounting base but other sprinkler designs might utilize smaller or larger angles. The present sprinkler is made of all plastic components except for threaded fasteners but any material can be utilized without departing from the spirit and scope of the invention. In addition, less weight is needed in a counterbalancing skirt which translates into lower starting pressures and improved startability of the wobbling of the wobbling water deflector head.

It should be clear at this time that an improved wobbling irrigation sprinkler head has been provided which uses a flared skirt which counterbalances the water deflector head to dampen vibration forces in the deflector head. However, the present invention is not to be construed as limited to the forms shown which are to be considered illustrative rather than restrictive.

We claim:

1. A wobbling irrigation sprinkler head comprising;

a base having an attachment portion for attaching to a water source;

a nozzle mounted to said base for directing water from said water supply therethrough;

a wobbling water deflector head having two end portions and being movably attached to said base between said two end portions and having a water deflector pad on one said end portion having a deflector surface positioned to deflect water being emitted from said nozzle to rotate said wobbling water deflector head; and a counterbalancing skirt on the other end portion of said wobbling water deflecting head, said counterbalancing skirt extending around a portion of said base and spaced from said base for rotation with said wobbling water deflector head;

whereby said counterbalancing skirt counterbalances said water deflector head to dampen vibration forces in said deflector head.

2. The wobbling irrigation sprinkler head in accordance with claim 1 in which said water deflecting head has a loose fitting sleeve portion mounted over a flange on said base to thereby allow a wobbling rotation of said water deflecting head on said base.

3. The wobbling irrigation sprinkler head in accordance with claim 2 in which said water deflecting pad is supported on the end of at least one supporting arm extending from said sleeve.

4. The wobbling irrigation sprinkler head in accordance with claim 3 in which said water deflecting pad is supported on the end of a plurality of supporting arms extending from said sleeve.

5. The wobbling irrigation sprinkler head in accordance with claim 3 in which said counterbalancing skirt is attached to said loose fitting sleeve and extends therefrom around said base.

6. The wobbling irrigation sprinkler head in accordance with claim 5 in which counterbalancing skirt has a plurality of open areas therein.

7. The wobbling irrigation sprinkler head in accordance with claim 6 in which said counterbalancing skirt flares from said water deflector head adjacent to and surrounding said base.

8. The wobbling irrigation sprinkler head in accordance with claim 7 in which said counterbalancing skirt is positioned for the balancing point of the wobbling deflector head to be between 0.15 and 0.5 inches below the rotation point of said wobbling deflector head.

9. The wobbling irrigation sprinkler head in accordance with claim 7 in which said counterbalancing skirt is made of plastic.

10. The wobbling irrigation sprinkler head in accordance with claim 7 in which said water deflector head deflector pad surface has grooved channels arcuately formed therein shaped to rotate said deflector head.

* * * * *